US006978913B2

(12) United States Patent
Rousselet et al.

(10) Patent No.: US 6,978,913 B2
(45) Date of Patent: Dec. 27, 2005

(54) MEMBRANE PUMP AND CONTAINER EQUIPPED THEREWIH

(75) Inventors: Guilhem Rousselet, Paris (FR); Daniel Crosnier, Offranville (FR)

(73) Assignee: L'Oreal S.A., Paris (FR)

( * ) Notice: Subject to any disclaimer, the term of this patent is extended or adjusted under 35 U.S.C. 154(b) by 377 days.

(21) Appl. No.: 10/157,842

(22) Filed: May 31, 2002

(65) Prior Publication Data

US 2003/0042272 A1 Mar. 6, 2003

(30) Foreign Application Priority Data

May 31, 2001 (FR) ..... 01 07164

(51) Int. Cl.[7] ..... B67D 5/42
(52) U.S. Cl. ..... 222/207; 222/321.9
(58) Field of Search ..... 222/321.9, 207

(56) References Cited

U.S. PATENT DOCUMENTS 3,527,551 A 9/1970 Kutik et al.
5,687,884 A 11/1997 Bodin et al.
5,704,519 A 1/1998 Crosnier et al.
6,305,581 B1 10/2001 Bonningue et al.

FOREIGN PATENT DOCUMENTS

EP 1 070 670 1/2001
FR 2 728 809 7/1996
FR 2 796 672 1/2001

*Primary Examiner*—Philippe Derakshani
(74) *Attorney, Agent, or Firm*—Finnegan, Henderson, Farabow, Garrett & Dunner, L.L.P.

(57) ABSTRACT

A pump may comprise a body, and a member movable relative to the body substantially along an axis of the pump. A pumping chamber may be defined by at least the body and the member. The pumping chamber may comprise a peripheral wall. The pump may further comprise an elastically deformable membrane comprising a first portion and a second portion. The first portion may be axially fixed relative to the peripheral wall, as well as being in contact with an inner surface of the peripheral wall at least in the presence of overpressure in the pumping chamber, and configured to place the pumping chamber in selective communication with at least one inlet passage. The second portion may be configured to place the pumping chamber in selective communication with at least one outlet passage.

52 Claims, 6 Drawing Sheets

MEMBRANE PUMP AND CONTAINER EQUIPPED THEREWIH

The present invention relates to a pump that can be associated with various rigid or flexible containers used, for example, in cosmetics, pharmaceuticals, or the food industry. The pump could be used as a dosing device, and the containers may include bottles, tubes, or jars.

Some conventional pumps comprise a push-button movably mounted on a body secured to a container containing a product to be dispensed. The push-button may comprise a cylindrical central conduit provided with radial openings and defining a variable-volume annular pumping chamber around the central conduit. A membrane may be mounted on the body. The membrane may comprise a central, sleeve-like portion open at a first, upper end and closed at a second, lower end. The central conduit of the push-button is inserted into the membrane until it contacts a bottom wall of the sleeve-like portion.

The membrane may also comprise an outer annular lip that presses against a peripheral wall of the pumping chamber in the presence of an overpressure inside the pumping chamber. The membrane presses against the peripheral wall in such a way as to prevent any fluid communication between the pumping chamber and the container during expulsion of a dose. Conversely, upon filling the chamber with a dose, the partial vacuum inside the pumping chamber makes the lip move away from the peripheral wall of the pumping chamber, thus allowing product to enter the pumping chamber.

The membrane may further comprise an elastic return portion configured to bring the push-button back into its initial position after dispensing a dose of product. During the return movement of the push-button, the membrane presses on the central conduit and isolates the pumping chamber from the radial openings of the central conduit in order to prevent air from re-entering the pumping chamber.

Although such conventional pumps may advantageously have a small number of parts and, therefore, have a relatively low manufacturing cost, they sometimes have drawbacks. For example, in some arrangements, axial movement between the sealing lip of a membrane and the peripheral wall of the pumping chamber (which is defined by a skirt of the push-button) may cause the lip to turn over and occupy a position where it is no longer usable, especially when the push-button returns to its upper position. As a result, the pump may become unusable.

The present invention may obviate one or more drawbacks of the related art. It should be understood, however, that the invention in its broadest aspect may not resolve some or all of the problems associated with the related technology.

The present invention is described herein by referring to a number of aspects and embodiments. It should be appreciated that the aspects and embodiments described herein are exemplary, and that the invention could be practiced without having one or more of the features of those aspects and embodiments.

According to one aspect of the invention, a pump may comprise a body, and a member movable relative to the body substantially along an axis of the pump. A pumping chamber may be defined by at least the body and the member. The pumping chamber may comprise a peripheral wall. The pump may further comprise an elastically deformable membrane comprising a first portion and a second portion. The first portion may be axially fixed relative to the peripheral wall, as well as being in contact with an inner surface of the peripheral wall at least in the presence of overpressure in the pumping chamber, and configured to place the pumping chamber in selective communication with at least one inlet passage. The second portion may be configured to place the pumping chamber in selective communication with at least one outlet passage.

The peripheral wall of the pumping chamber may be an outer side wall of the pumping chamber, for example. Optionally, the peripheral wall of the pumping chamber may be a part of the body.

As mentioned above, in one aspect, the first portion of the membrane may be axially fixed relative to the peripheral wall. The term "axially fixed" refers to the absence of relative axial movement between the first portion of the membrane and the peripheral wall. In some embodiments, the absence of relative movement may minimize stress on a lip of the membrane, substantially prevent the lip from turning over, and/or improve the seal between the membrane and the peripheral wall.

An outlet passage may be delimited, at least in part, by a central conduit formed by the movable member. The pumping chamber may be formed around the central conduit. The second portion may comprise an axial depression formed by the membrane and intended to receive a first end of the central conduit. The second portion may be configured to isolate the pumping chamber from the outlet passage in the presence of a partial vacuum inside the pumping chamber.

At least one relief, either hollow or projecting, may be provided, for example, on the central conduit, so as to facilitate the selective communication between the pumping chamber and the outlet passage.

During isolation of the pumping chamber from the outlet passage, the leaktightness at the outlet of the pumping chamber may be reinforced by forming an annular boss on one wall of the relief. The annular boss may be applied in a sealed manner to the central conduit at least in the presence of a partial vacuum inside the pumping chamber. In some embodiments, when the pressures are in equilibrium, the boss may also be applied in a sealed manner to the central conduit.

In an exemplary embodiment including the boss, the membrane may contact the central conduit at a small area. As a result, a low air pressure in the pumping chamber may be enough to break the seal between the membrane and the central conduit, thereby facilitating priming of the pump.

The selective communication between the pumping chamber and the outlet passage may be made via one or more openings delimited, for example, by one or more notches formed at a free edge of the first end of the central conduit.

A second end of the central conduit, opposite the first end, may be arranged so as to receive an actuator for actuating the pump. The actuator may be coupled to the central conduit by, for example, an interference fit, a snap-fastening, or a screw fastening.

The first portion of the membrane may comprise an annular lip formed by the membrane. The lip may be configured such that it is applied in a sealed manner against the peripheral wall at least in the presence of an overpressure inside the pumping chamber, and thus blocks passage of product from the pumping chamber to the inlet passage. In the presence of a partial vacuum inside the pumping chamber, the lip may move away from the peripheral wall and allow passage of product from the inlet passage to the pumping chamber.

In an embodiment, the movable member may comprise a piston movable, in response to an actuating command, from a first position where the pumping chamber has a maximum volume to a second position where the pumping chamber has a minimum volume. The piston may be returned to the first position by an elastic return force generated by the membrane when the actuating command ceases.

In an embodiment, the body may define an air intake passage configured to re-establish atmospheric pressure inside a container equipped with the pump on the return of the piston from the second position to the first position. Alternatively or additionally, the container may comprise a bag with flexible walls, or the pump may comprise a follower piston that moves inside the container as product is dispensed.

In an embodiment, the movable member may be configured to isolate the air intake passage from the outside when the piston is in the first position, for example, when the product to be dispensed is sensitive to air.

The membrane may be attached to a notched portion of the body, for example, a skirt delimiting notches, so as to provide permanent communication between the inlet passage of the pump and the first portion.

The membrane may be made of a thermoplastic or crosslinked elastomer, for example, a nitrile or silicone elastomer. It should be appreciated that the material forming the membrane may be chosen based on the product to be dispensed such that the properties of the material, for example, mechanical properties, are not altered on contact with the product and vice versa.

In an embodiment, the membrane may comprise a relatively hard elastomer such that a relatively high return force may be attained without having to unduly pre-stress the membrane.

In an embodiment, the material forming the membrane and the configuration of the membrane may be chosen such that the membrane may undergo an elongation ranging, in the position of maximum depression of the movable member, up to 300% of its length at rest.

Optionally, the body may be configured to fasten the pump to a container, for example, by snap-fastening or by screwing. The body may also comprise a skirt capable of engaging an inside surface of an open neck of the container in a sealed manner.

The pump may comprise a dip tube in communication with the inlet passage. The dip tube may be configured to have its free end substantially at the bottom of the container. In the case of a container with a variable volume, for example, a bag, a dip tube may not be necessary.

The body, the movable member, and the push-button may be manufactured by molding thermoplastics such as, for example, polypropylenes or polyethylenes.

According to another aspect of the invention, an assembly may comprise a pump and a container associated with the pump. The body of the pump may be fastened to the container by one of snap-fastening and screwing. The body may also comprise a skirt configured to sealingly engage an inside surface of an open neck of said container. The assembly may further comprise a cosmetic product contained in the container.

In an embodiment of the assembly, the body may define an air intake passage configured to re-establish atmospheric pressure inside the container when the piston returns from the second position to the first. The movable member may be configured to isolate the air intake passage from atmosphere when the piston is in the first position According to still another aspect of the invention, a dispenser may comprise a pump, a container associated with the pump, and an actuator configured to actuate the pump. The dispenser may further comprise a cosmetic product contained in the container.

According to another aspect, a pump may comprise a pumping chamber, a body forming a peripheral wall of the pumping chamber, and a member forming an inner wall of the pumping chamber, wherein the member may be movable relative to the body. The pump may also comprise an elastically deformable membrane comprising a first portion and a second portion, wherein the member may be movable relative to the first portion. The first portion may be in contact with an inner surface of the peripheral wall at least in the presence of overpressure in the pumping chamber, the first portion may be configured to place the pumping chamber in selective communication with at least one inlet passage, and the second portion may be configured to place the pumping chamber in selective communication with at least one outlet passage. In an embodiment, the first portion of the membrane may be axially fixed relative to the peripheral wall.

According to yet another aspect, a pump may comprise a pumping chamber, a body forming a peripheral wall of the pumping chamber, and a member forming an inner wall of the pumping chamber, wherein the member may be movable relative to the body. The pump may also comprise an elastically deformable membrane comprising a first portion and a second portion, wherein the first portion may be in contact with an inner surface of the peripheral wall at least in the presence of overpressure in the pumping chamber. The first portion may be configured to place the pumping chamber in selective communication with at least one inlet passage defined by the body, and the second portion may be configured to place the pumping chamber in selective communication with at least one outlet passage. In an embodiment, the first portion of the membrane may be axially fixed relative to the peripheral wall.

A container equipped with a pump in accordance with any of the above aspects may be suitable for the packaging and dispensing of cosmetic products, for example, care, make-up, or personal hygiene products, hair products, and/or sunscreens that protect against the harmful rays of the sun.

Aside from the structural arrangements described above, the invention could include a number of other arrangements, such as those explained hereinafter. It is to be understood that both the foregoing description and the following description are exemplary and explanatory only and are not restrictive of the invention.

The accompanying drawings are included to provide a further understanding of the invention and are incorporated in and constitute a part of this specification. The drawings illustrate some exemplary embodiments of the invention and, together with the description, serve to explain some principles of the invention. In the drawings, FIG. 1 is a perspective view of a packaging and dispensing assembly equipped with a pump according to an exemplary aspect of the invention;

Reference will now be made in detail to exemplary embodiments of the invention, examples of which are illustrated in the accompanying drawings. Wherever possible, the same reference numbers are used throughout the drawings and in the description to refer to the same or like parts.

Figure 1:
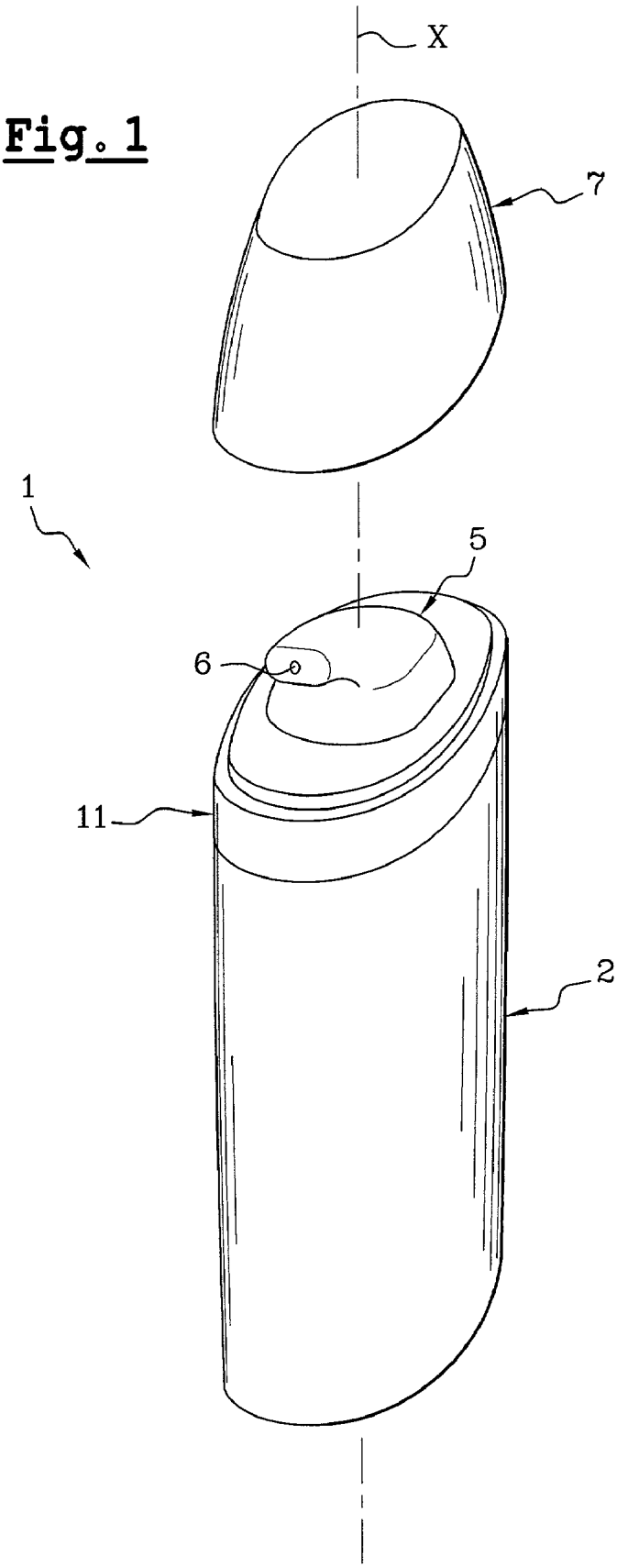
Figure 2:
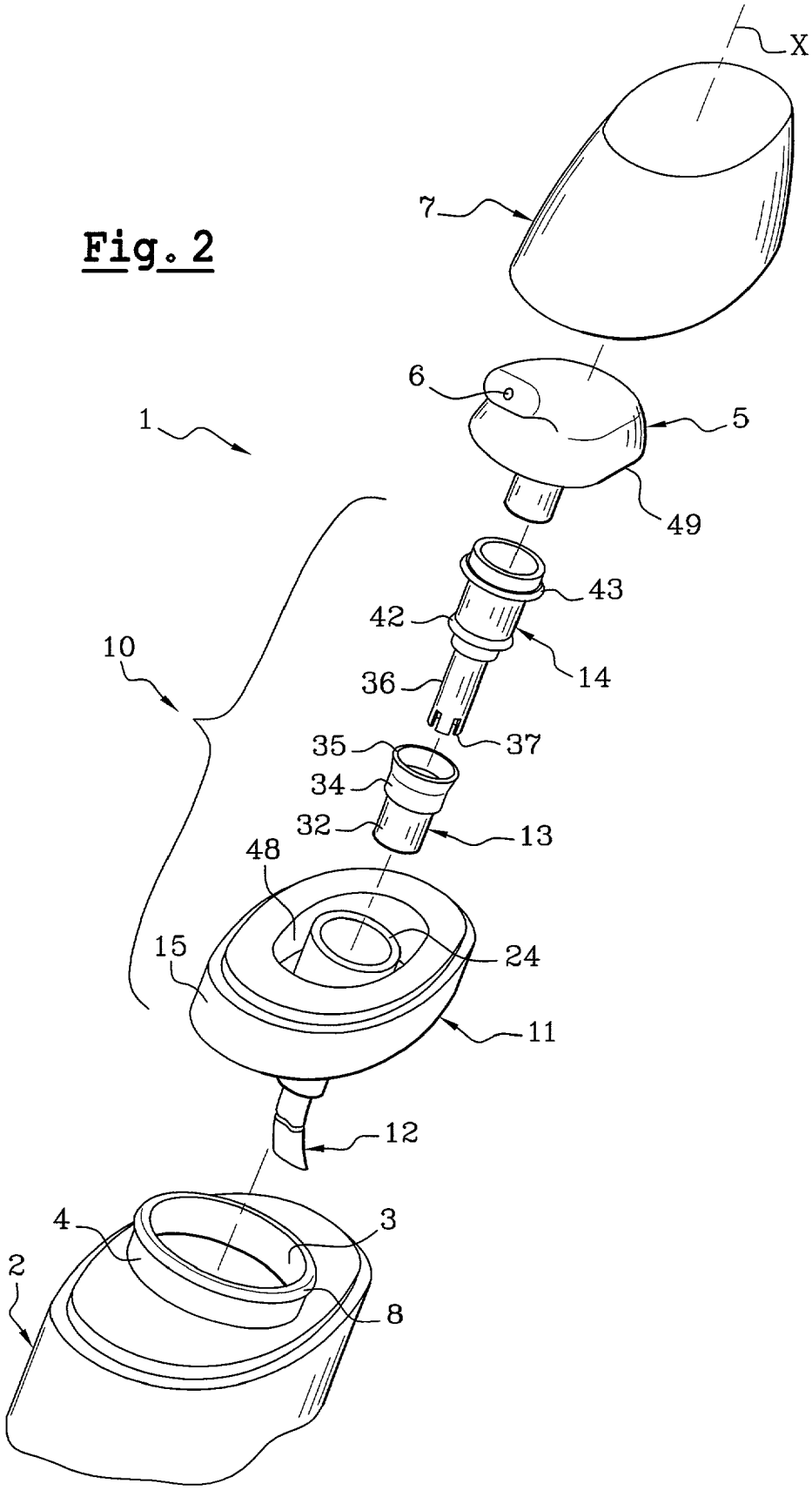
FIG. 2 is an exploded view of the assembly of FIG. 1.

In accordance with the invention, a membrane pump for a container is provided. Referring to FIGS. 1 and 2, an assembly 1 may comprise a rigid or semi-rigid container 2, having an opening 3 delimited by a neck 4. The container 2 may be configured as, for example, a bottle, a tube, or a jar. The container 2 may comprise, for example, polypropylene.

A pump 10 may be mounted, for example, by snap-fastening, to the neck 4 of the container 2. The pump 10 may be manually actuatable by any type of actuator. For example, the actuator may be a push-button 5 mounted on the pump 10. Actuating the pump 10 may cause product to be output through an outlet orifice 6. A removable cap 7 may be placed on the push-button 5, for example, to prevent unintentional actuation.

In an embodiment, the pump 10 may comprise a body 11 configured to be fixedly mounted on the neck 4 of the container 2. The body may be coupled to a dip tube 12 having a free end intended to be placed substantially in the vicinity of the bottom of the container 2. The pump 10 may also comprise an elastically deformable membrane 13 mounted on the body 11 and an intermediate member 14 movable with respect to the body 11. The push-button 5 may be fixedly mounted on the movable member 14.

Figure 3A:
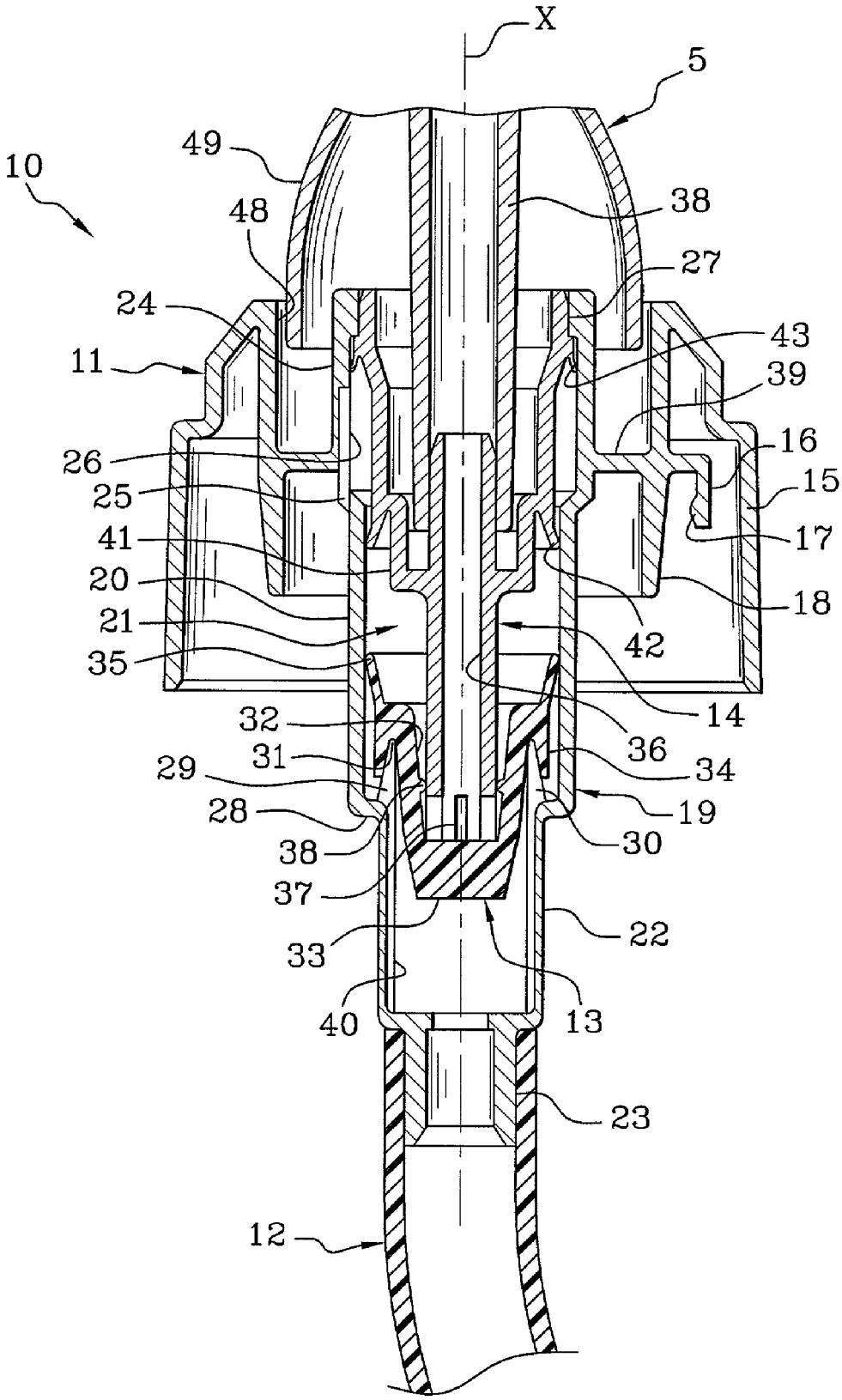
FIGS. 3A–3D are sectional views of the assembly of FIGS. 1 and 2 illustrating an exemplary operation of the pump.

Referring now to FIG. 3A, the pump 10 may comprise a body 11 intended to be fixedly mounted on the container 2. The body 11 may be made, for example, of polypropylene. The body 11 make also comprise a skirt-like rim 15 and, inside the skirt-like rim, a plurality of tabs 16. Each of the tabs 16 may comprise a flange 17 near a free end of the tab 16. Each flange 17 may be capable of cooperating, for example, by snap-fastening, with a corresponding flange 8 provided on the neck 4 of the container 2 (FIG. 2). The body 11 may also comprise a skirt 18 intended to form a seal with an inner surface of the neck 4 at the opening 3 of the container 2.

The body 11 may also define an annular groove 48 configured to receive a skirt-like rim 49 of the push-button 5, so as to guide the actuating movement of the push-button 5.

The body 11 may comprise a funnel 19 along an axis X of the body 11. The axial funnel 19 may, over part of its height, define an outer side wall 20 of a pumping chamber 21. A first portion 22 and a second portion 23 of the axial funnel 19 may protrude beyond the pumping chamber 21 in a direction toward the bottom of the container. The first portion 22 may have a diameter less than a diameter of the pumping chamber 21, and the second portion 23 may have a diameter less than the diameter of the first portion 22. An end of the dip tube 12 may be coupled to the second portion 23 of the funnel 19, for example, by an interference fit.

At an end opposite first and second portions 22, 23, a skirt portion 24 of the axial funnel 19 may extend beyond the pumping chamber 21. The skirt portion 24 may have a diameter greater than the diameter of the pumping chamber 21. An orifice 25, oriented parallel to the axis X, may pass through the funnel 19 at a shoulder formed between the pumping chamber 21 and the skirt portion 24. The orifice 25 may extend to a groove 26 formed parallel to the axis X on an inner surface of the skirt portion 24. The groove may extend, for example, over about half of an axial height of the skirt portion 24.

The axial funnel 19 may be coupled to the sealing skirt 18 via a transverse annular wall 39 disposed axially at a lower part of the skirt portion 24. The skirt portion 24 may be terminated at its free end by a portion of smaller cross section 27. The portion of smaller cross section 27 may form a top end stop for the movable member 14.

A shoulder 28 may be defined between the pumping chamber 21 and the first portion 22 of the funnel 19. A plurality of spaced tabs 29, 30 may be positioned around and project axially from the shoulder 28. Grooves 40 may extend from the tabs 29, 30 on the inner surface of the first portion 22. The grooves 40 may extend axially over the entire height of the first portion 22 of the funnel 19.

The tabs 29, 30 may define a plurality of notches. The notched portion formed by the tabs 29, 30 may receive a substantially U-shaped annular groove 31 of the elastomeric membrane 13. A closed bottom 33 of the groove 31 is in the direction of the pumping chamber 21. The membrane 13 forms an axial housing 32 having a cross-section that decreases slightly in a direction of the closed bottom 33.

At an end opposite the bottom 33, the housing 32 is connected via the U-shaped groove 31 to an outer annular skirt 34. The skirt 34 may comprise a free edge in a direction of the shoulder 28. The annular skirt 34 may have an axial height less than the height of the tabs 29, 30. In a direction away from the skirt 34, the member 13 defines an annular lip 35, capable of being applied in a sealed manner against the inner surface of the peripheral wall 20 of the pumping chamber 21 when there is no partial vacuum inside the pumping chamber.

An axially movable intermediate member 14 may be mounted inside the axial funnel 19. The intermediate member 14 may comprise, for example, polyethylene. The intermediate member 14 may comprise an axial tube 36 having a free end inside the housing 32 formed by the membrane 13 and engaged with the bottom 33 of the membrane. The free end of the tube 36 may have an edge delimiting a series of notches 37. The membrane 13 may be lightly coupled to the axial tube 36. An annular ridge 38 formed on the inner surface of the housing 32 may sealingly contact the axial tube 36 at an axial level located above the notches 37.

A tubular element 38 formed by the push-button 5 may be coupled to an end of the tube 36 away from the notches 37. The tubular element 38 may be in communication with the outlet orifice 6 of the push-button 5. The push-button 5 may be coupled to the tube by an interference fit.

The movable member 14 may also define a first piston 41 comprising an annular lip 42 configured to sealingly contact the inner surface of the peripheral wall 20 of the pumping chamber. Thus, the membrane 13, the peripheral wall 20, and the piston 41 may define the pumping chamber 21. The volume of the pumping chamber 21 may vary depending on the axial position of the movable member 14. The axial tube 36 may define an outlet passage for the pump 10 in communication with the outlet orifice 6 via the tubular portion 38 of the push-button 5. The first portion 22 of the axial funnel 19, located upstream of the membrane 13, may define an inlet passage for the pump in communication with the dip tube 12.

The movable member 14 may comprise a second lip 43 near its upper end. The second lip 43 may, in a high position of the movable member 14, sealingly contact the inner surface of the skirt portion 24 so as to isolate the air intake orifice 25 from the outside atmosphere. When the movable member 14 is driven downwards, a portion of the lip 43 may face the axial groove 26, placing the air intake orifice 25 in communication with the outside atmosphere.

In FIG. 3A, the pump 10 is in a rest position; that is, in the high position of the push-button 5. In the rest position, the movable member 14 is at the high end stop against the portion 27 of the axial funnel 19, the lip 43 isolates the air intake orifice 25 from the outside in a sealed manner, and the pumping chamber 21 has a maximum volume. The annular lip 35 of the membrane 13 sealingly contacts the inner surface of the peripheral wall 20 of the pumping chamber 21, thereby isolating the pumping chamber 21 of the inlet passage 22. The annular flange 38 of the membrane 13 isolates the pumping chamber 21 from the outlet passage 36 in a sealed manner.

Figure 3B:
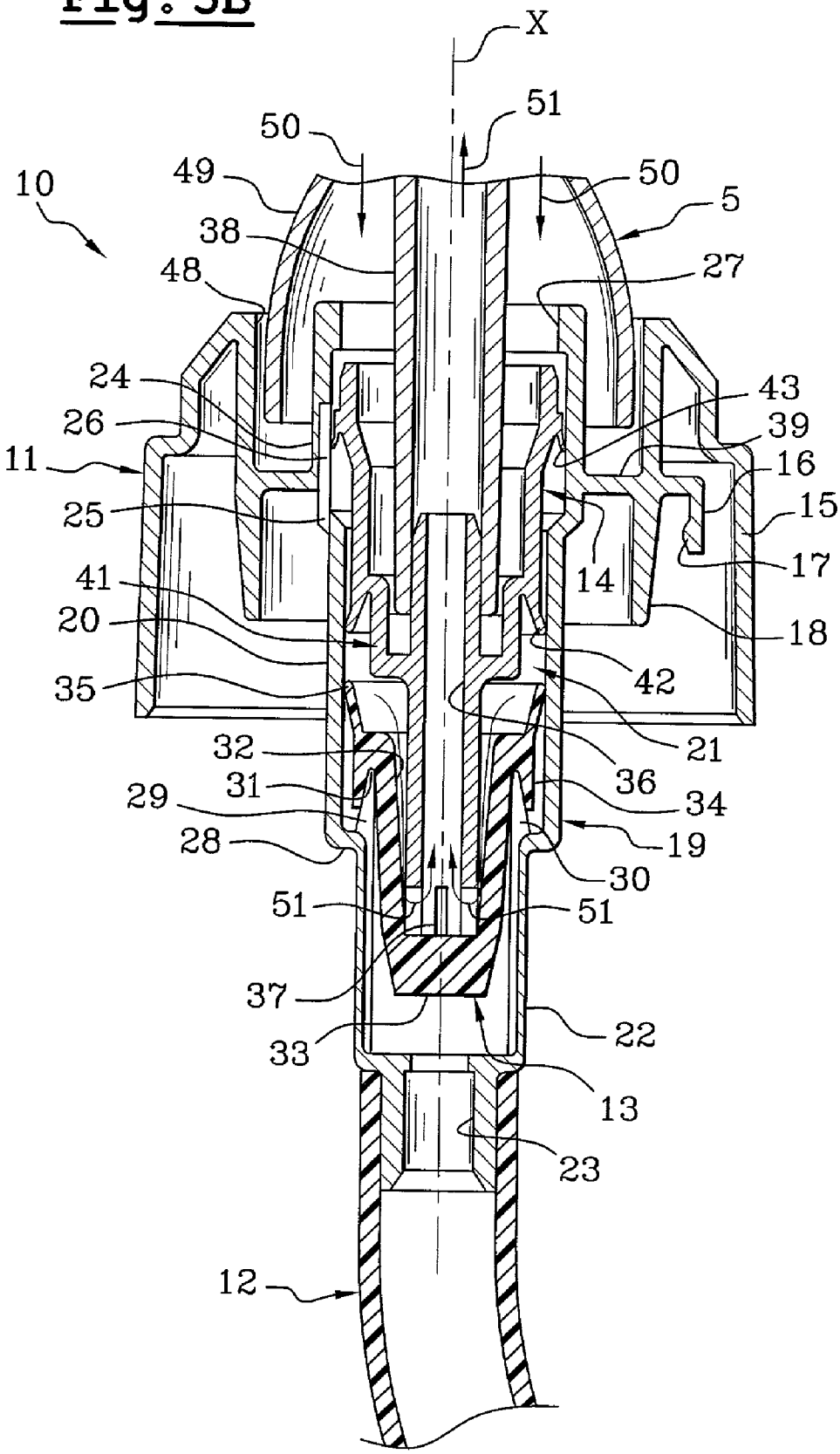

Referring to FIG. 3B, in response to a pressure exerted axially on the push-button 5 (as indicated by the arrows 50), the movable member 14 descends and causes a downward extension of the membrane 13. The pressure of product on the annular lip 35 increases the pressure of the lip 35 on the peripheral wall 20. The increased pressure on the peripheral wall 20 blocks passage of product from the pumping chamber 21 towards the inlet passage 22. In the stretched position of the membrane 13, pressurized product forces the flange 38 to be removed from contact with the movable member 14, and product enters the axial tube 36 via the notches 37. The flow of product from the pumping chamber 21 towards the outlet orifice is indicated by the arrows 51.

Figure 3C:
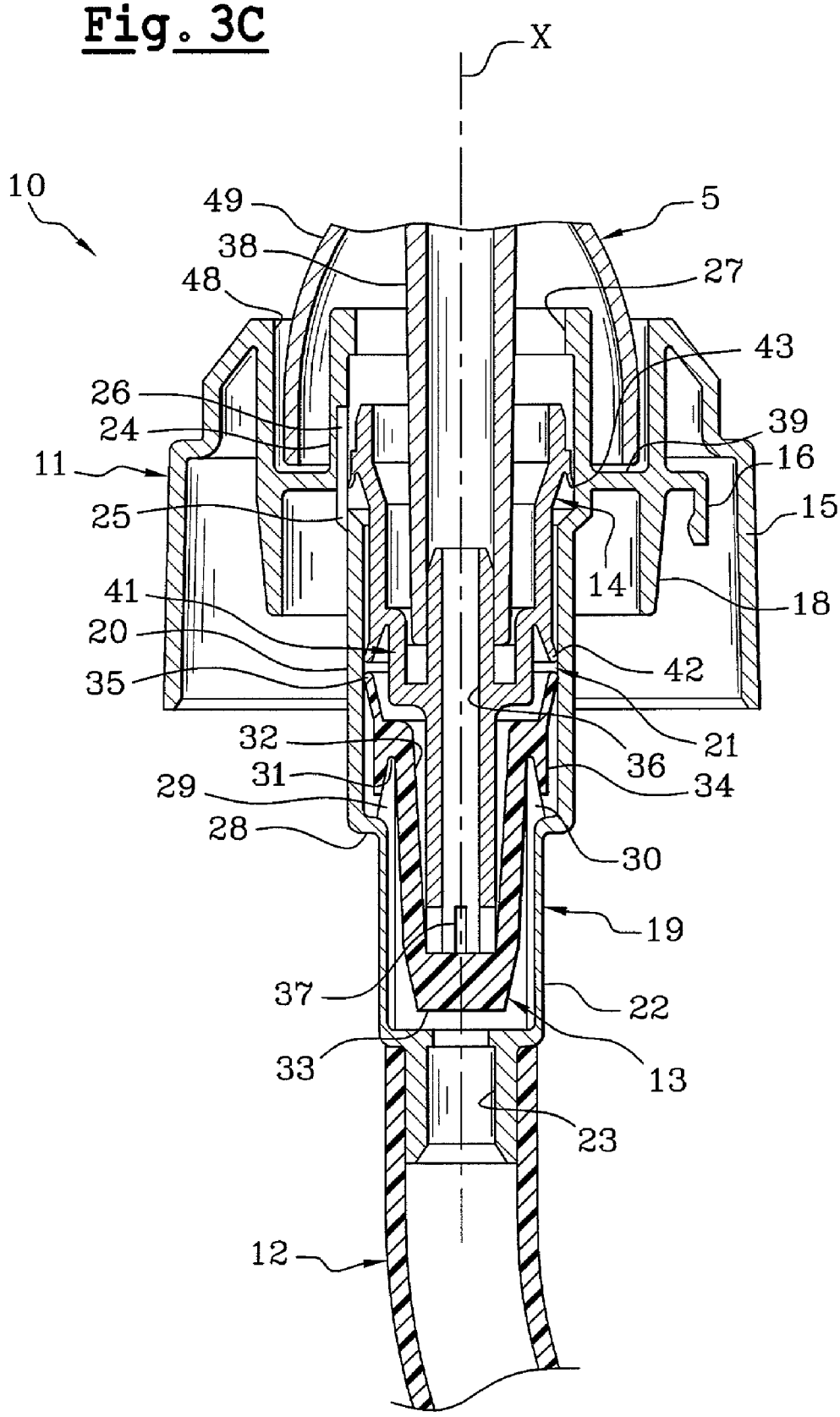

The downward movement of the movable member 14 may continue until the pumping chamber 21 has a minimum volume (FIG. 3C). In this position, most of the product in the pumping chamber 21 has been dispensed via the axial tube 36, the tubular conduit 38, and the outlet orifice 6 of the push-button 5. In this lowest position of the movable member 14, the annular lip 43 of the movable member 14 is facing the groove 26, and the air intake orifice 25 is therefore in communication with the outside atmosphere.

Figure 3D:
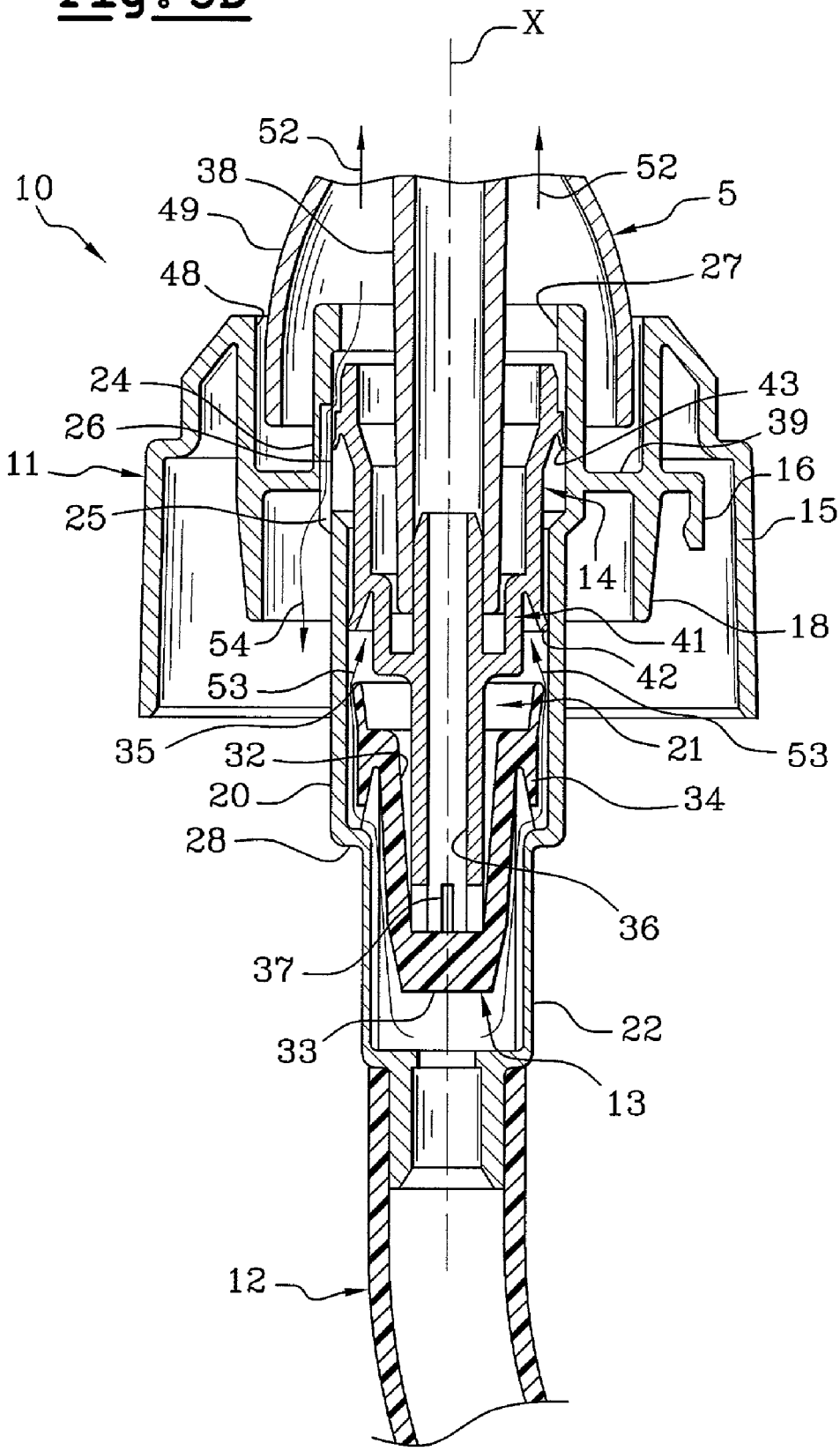

As illustrated by FIG. 3D, when the user relaxes the pressure exerted on the push-button 5, the push-button 5 and the movable member 14 move back upwards (as indicated by arrows 52) under an elastic return force exerted by the membrane 13. The rising movement of the movable member 14 creates a vacuum inside the pumping chamber 21. Under the effect of the vacuum, the annular lip 35 moves away from the peripheral wall 20 and allows product to enter the pumping chamber 21 from the inlet passage 22 via the passages formed between the tabs 29, 30 below the free edge of the skirt 34. The flow of product entering inside the pumping chamber 21 is indicated by the arrows 53.

During this rising movement of the push-button 5, the vacuum inside the pumping chamber 21, in combination with the return of the membrane 13 to its unstretched position, restores the sealing contact of the membrane 13 with the axial tube 36. The sealing contact of the membrane 13 with the axial tube 36 prevents entry of air into the pumping chamber and return of residual product from the axial tube 36 towards the pumping chamber 21. For at least a portion of the rising movement of the moveable member 14, the annular lip 43 faces the groove 26. As a result, and because of the partial vacuum created inside the container, air is sucked into the container via the orifice 25. The flow of returning air is indicated by the arrow 54.

The rising movement of the movable member 14 continues until the movable member 14 bears against the high end stop 27. At this moment, pressure equilibrium is re-established, and the pump 10 is ready for a new dispensing.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A pump comprising:

a body;

a member movable relative to the body substantially along an axis of the pump;

a pumping chamber defined by at least the body and the member, the pumping chamber comprising a peripheral wall; and an elastically deformable membrane comprising a first portion and a second portion, the first portion being axially fixed relative to the peripheral wall, the first position being in contact with an inner surface of the peripheral wall at least in the presence of overpressure in the pumping chamber, the first portion being configured to place the pumping chamber in selective communication with at least one inlet passage, and the second portion being configured to place the pumping chamber in selective communication with at least one outlet passage.

2. The pump according to claim 1, wherein at least a portion of the body defines the peripheral wall of the pumping chamber.

3. The pump according to claim 1, wherein the outlet passage is delimited at least in part by a central conduit defined by the movable member, and the pumping chamber surrounds the central conduit.

4. The pump according to claim 3, wherein the second portion of the membrane comprises an axial recess configured to receive a first end of the central conduit so as to isolate the pumping chamber from the outlet passage at least in the presence of a partial vacuum inside the pumping chamber.

5. The pump according to claim 4, wherein the membrane comprises an annular boss formed on one wall of the recess, the boss, at least in the presence of a partial vacuum inside the pumping chamber, being applied in a sealed manner to the central conduit.

6. The pump according to claim 4, wherein the selective communication between the pumping chamber and the outlet passage is via at least one opening in the first end of the central conduit.

7. The pump according to claim 6, wherein said opening is delimited by at least one notch formed at a free edge of the first end of the central conduit.

8. The pump according to claim 4, wherein a second end of the central conduit, opposite the first end, is configured to receive an actuator for the pump.

9. The pump according to claim 8, further comprising the actuator, wherein the actuator is coupled to the second end by an interference fit.

10. The pump according to claim 1, wherein the first portion of the membrane comprises an annular lip configured such that, in the presence of an overpressure inside the pumping chamber, the lip is applied in a sealed manner against the peripheral wall and blocks passage of product from the pumping chamber to the inlet passage, and in the presence of a partial vacuum inside the pumping chamber, the lip moves away from said peripheral wall and allows passage of product from the inlet passage to the pumping chamber.

11. The pump according to claim 1, wherein the movable member comprises a piston movable from a first position in which the pumping chamber has a maximum volume to a second position in which the pumping chamber has a minimum volume.

12. The pump according to claim 11, wherein the membrane is configured to generate an elastic return force forcing the piston to the first position.

13. The pump according to claim 1, wherein the membrane is coupled to a notched portion of the body so as to provide permanent communication between the inlet passage of the pump and the first portion of the membrane.

14. The pump according to claim 13, wherein the notched portion comprises a plurality of tabs delimiting notches in the body.

15. The pump according to claim 1, wherein the membrane comprises one of a thermoplastic and a crosslinked elastomer.

16. The pump according to claim 15, wherein the membrane comprises one of a nitrile elastomer and a silicone elastomer.

17. The pump according to claim 1, further comprising a dip tube in communication with the inlet passage.

18. The pump according to claim 1, wherein the pumping chamber is further defined by the membrane.

19. An assembly comprising:

the pump according to claim 1; and a container associated with the pump.

20. The assembly according to claim 19, wherein the body of the pump is fastened to the container by one of snap-fastening and screwing.

21. The assembly according to claim 20, wherein the body comprises a skirt configured to sealingly engage an inside surface of an open neck of said container.

22. The assembly according to claim 19, further comprising a cosmetic product contained in the container.

23. A dispenser comprising:

the assembly of claim 19; and an actuator configured to actuate the pump.

24. The dispenser according to claim 23, further comprising a cosmetic product contained in the container.

25. An assembly comprising:

the pump according to claim 12; and a container associated with the pump, wherein the body defines an air intake passage configured to re-establish atmospheric pressure inside the container when the piston returns from the second position to the first position.

26. The assembly according to claim 25, wherein the movable member is configured to isolate the air intake passage from atmosphere when the piston is in the first position.

27. A pump comprising:

a pumping chamber;

a body forming a peripheral wall of the pumping chamber;

a member forming an inner wall of the pumping chamber, the member being movable relative to the body; and an elastically deformable membrane comprising a first portion and a second portion, the member being movable relative to the first portion, the first portion being in contact with an inner surface of the peripheral wall at least in the presence of overpressure in the pumping chamber, the first portion being configured to place the pumping chamber in selective communication with at least one inlet passage, and the second portion being configured to place the pumping chamber in selective communication with at least one outlet passage.

28. The pump according to claim 27, wherein the first portion of the membrane is axially fixed relative to the peripheral wall.

29. The pump according to claim 27, wherein the outlet passage is delimited at least in part by a central conduit defined by the movable member, and the pumping chamber surrounds the central conduit.

30. The pump according to claim 29, wherein the second portion of the membrane comprises an axial recess configured to receive a first end of the central conduit so as to isolate the pumping chamber from the outlet passage at least in the presence of a partial vacuum inside the pumping chamber.

31. The pump according to claim 30, wherein the membrane comprises an annular boss formed on one wall of the recess, the boss, at least in the presence of a partial vacuum inside the pumping chamber, being applied in a sealed manner to the central conduit.

32. The pump according to claim 30, wherein the selective communication between the pumping chamber and the outlet passage is via at least one opening in the first end of the central conduit.

33. The pump according to claim 27, wherein the first portion of the membrane comprises an annular lip configured such that, in the presence of an overpressure inside the pumping chamber, the lip is applied in a sealed manner against the peripheral wall and blocks passage of product from the pumping chamber to the inlet passage, and in the presence of a partial vacuum inside the pumping chamber, the lip moves away from said peripheral wall and allows passage of product from the inlet passage to the pumping chamber.

34. The pump according to claim 27, wherein the movable member comprises a piston movable from a first position in which the pumping chamber has a maximum volume to a second position in which the pumping chamber has a minimum volume.

35. The pump according to claim 27, wherein the membrane is coupled to a notched portion of the body so as to provide permanent communication between the inlet passage of the pump and the first portion of the membrane.

36. The pump according to claim 27, wherein the pumping chamber is further defined by the membrane.

37. An assembly comprising:

the pump according to claim 27; and a container associated with the pump.

38. The assembly according to claim 37, further comprising a cosmetic product contained in the container.

39. A dispenser comprising:

the assembly of claim 37; and an actuator configured to actuate the pump.

40. A pump comprising:

a pumping chamber;

a body forming a peripheral wall of the pumping chamber;

a member forming an inner wall of the pumping chamber, the member being movable relative to the body; and an elastically deformable membrane comprising a first portion and a second portion, the first portion being in contact with an inner surface of the peripheral wall at least in the presence of overpressure in the pumping chamber, the first portion being configured to place the pumping chamber in selective communication with at least one inlet passage defined by the body, and the second portion being configured to place the pumping chamber in selective communication with at least one outlet passage.

41. The pump according to claim 40, wherein the first portion of the membrane is axially fixed relative to the peripheral wall.

42. The pump according to claim 40, wherein the outlet passage is delimited at least in part by a central conduit defined by the movable member, and the pumping chamber surrounds the central conduit.

43. The pump according to claim 42, wherein the second portion of the membrane comprises an axial recess configured to receive a first end of the central conduit so as to isolate the pumping chamber from the outlet passage at least in the presence of a partial vacuum inside the pumping chamber.

44. The pump according to claim 43, wherein the membrane comprises an annular boss formed on one wall of the recess, the boss, at least in the presence of a partial vacuum inside the pumping chamber, being applied in a sealed manner to the central conduit.

45. The pump according to claim 43, wherein the selective communication between the pumping chamber and the outlet passage is via at least one opening in the first end of the central conduit.

46. The pump according to claim 40, wherein the first portion of the membrane comprises an annular lip configured such that, in the presence of an overpressure inside the pumping chamber, the lip is applied in a sealed manner against the peripheral wall and blocks passage of product from the pumping chamber to the inlet passage, and in the presence of a partial vacuum inside the pumping chamber, the lip moves away from said peripheral wall and allows passage of product from the inlet passage to the pumping chamber.

47. The pump according to claim 40, wherein the movable member comprises a piston movable from a first position in which the pumping chamber has a maximum volume to a second position in which the pumping chamber has a minimum volume.

48. The pump according to claim 40, wherein the membrane is coupled to a notched portion of the body so as to provide permanent communication between the inlet passage of the pump and the first portion of the membrane.

49. The pump according to claim 40, wherein the pumping chamber is further defined by the membrane.

50. An assembly comprising:

the pump according to claim 40; and a container associated with the pump.

51. The assembly according to claim 50, further comprising a cosmetic product contained in the container.

52. A dispenser comprising:

the assembly of claim 50; and an actuator configured to actuate the pump.

* * * * *